US007621326B2

(12) United States Patent
Crichlow

(10) Patent No.: US 7,621,326 B2
(45) Date of Patent: Nov. 24, 2009

(54) PETROLEUM EXTRACTION FROM HYDROCARBON FORMATIONS

(76) Inventor: Henry B Crichlow, 330 W. Gray St., Suite 504, Norman, OK (US) 73069

( * ) Notice: Subject to any disclaimer, the term of this patent is extended or adjusted under 35 U.S.C. 154(b) by 377 days.

(21) Appl. No.: 11/279,681

(22) Filed: Apr. 13, 2006

(65) Prior Publication Data

US 2007/0175638 A1 Aug. 2, 2007

Related U.S. Application Data

(60) Provisional application No. 60/763,844, filed on Feb. 1, 2006.

(51) Int. Cl.
*E21B 43/24* (2006.01)

(52) U.S. Cl. ..... 166/272.5; 166/50; 166/272.7

(58) Field of Classification Search ..... 166/272.7, 166/272.5, 272.3, 50
See application file for complete search history.

(56) References Cited

U.S. PATENT DOCUMENTS 3,386,508 A * 6/1968 Bielstein et al. ..... 166/272.3
4,099,570 A * 7/1978 Vandergrift ..... 166/303
4,270,609 A * 6/1981 Choules ..... 166/272.3
4,368,781 A * 1/1983 Anderson ..... 166/252.4
4,460,044 A * 7/1984 Porter ..... 166/252.1
4,572,299 A * 2/1986 Vanegmond et al. ..... 166/385
5,016,710 A * 5/1991 Renard et al. ..... 166/245
5,074,360 A * 12/1991 Guinn ..... 166/281
7,100,687 B2 * 9/2006 Pauley ..... 166/245

* cited by examiner

*Primary Examiner*—Hoang Dang

(57) ABSTRACT

Recovery of viscous hydrocarbon by hot fluid injection from subterranean formations is assisted by using a specially designed and under-reamed vertical well to form a central production cavity; combined with a plurality of specially perforated horizontal wells drilled from the surface down to the producing formation, and then drilled laterally to intersect and be operatively connected to the central production well cavity. These continuous horizontal uniwells™ behave as single wells with two wellheads, each with multiple injection-production perforation pairs, between which the controlled flow of hot oil via a specialized annular communication zone. The production process is controlled by modulating the hot oil flow where the wellbore fluids act as a hydraulic "P-trap" seal limiting steam bypass. The hot displaced oil is allowed to drain from the lateral horizontal wells in to the central collection cavity.

34 Claims, 16 Drawing Sheets

PETROLEUM EXTRACTION FROM HYDROCARBON FORMATIONS

CROSS REFERENCE TO RELATED APPLICATIONS

This application claims priority from Disclosure Document 589,546 by Dr. Henry Crichlow filed on Nov. 7, 2005 and Provisional Patent 60/763,844 filed on Feb. 1, 2006 by Dr. Henry Crichlow.

INTRODUCTION

This invention relates generally to a new technology application and a new type of oil well for recovery of hydrocarbons from subterranean oil bearing formations.

This invention is related to prior filings by the same applicant, pertaining to the overall recovery of hydrocarbons from subterranean oil formations. The technology involves the novel use and application of equipment and techniques in which horizontal wells are drilled from the surface down to and across an oil bearing formation and back up to the surface, in a manner similar to that of drilling under a river crossing when laying pipelines across country. This new type of horizontal well is called a Uniwell™ because it has two surface wellheads one at each end of the axis of the horizontal system. Either wellhead can be used for either injection or production as needed by the operator. In addition, this invention utilizes a collection cavity drilled into and below the horizontal well (s) to form a collection site for the produced oil.

The technology is a new application using some elements of an existing drilling technology, which have hitherto been used only in horizontal pipeline crossing installations and some technology elements, which have been used in conventional oil well drilling. This novel completion technique uses injection and production perforations in the same wellbore, separated by a moveable wellbore packer.

FIELD OF INVENTION

THIS INVENTION is a unique new approach for heavy oil recovery. The invention is particularly suited to making heavy oil formations, oil shales and tar sands producible by a single wellbore system drilled using a specialized form of horizontal directional drilling. The invention however is not limited to recovery of heavy oils only; it can be used for many oil recovery processes such as tar sands and oil shale. In this application tar sands also means oil sands and each term is mutually interchangeable.

With this invention, the operator drills a new type of well that has all the operational benefits of a horizontal well and in addition this drilling can be implemented either by using modified equipment that is readily available in allied industries such as pipeline laying or by modifying existing oil well drilling rigs. This novel drilling approach effectively lowers costs and increases efficiencies because it can utilize available equipment to drill wells with greater productive capacity. This approach allows wells to be drilled over large lateral distances, up to as much as 5,000 feet in shallow depth oilfields. At greater depths, the lateral extension is limited by the rig capability and mechanical limitations of torque and drag in the drilling process. The reaming process to drill the collection cavity is done with conventional under-reaming tools which can easily construct a cavity up to 96 inches in diameter in the hydrocarbon formation. With this innovation, which involves in part, the injection and production from the same well, increased levels of oil recovery are achievable in field practice.

BACKGROUND OF THE INVENTION

Introduction:

Heavy hydrocarbons in the form of petroleum deposits are distributed worldwide and the heavy oil reserves are measured in the hundreds of billions of recoverable barrels. Because of the relatively high oil viscosity, which can exceed $10^6$ cp, these crude deposits are essentially immobile and cannot be easily recovered by conventional primary and secondary means. The only economically viable means of oil recovery is by the addition of heat to the oil deposit, which significantly decreases the viscosity of the oil by several orders of magnitude and allows the oil to flow from the formation into the producing wellbore. Today, the steam injection can be done in a continuous fashion or intermittently as in the so-called "huff and puff" or cyclic steam process. Oil recovery by steam injection involves a combination of physical processes including, gravity drainage, steam drive and steam drag to move the heated oil from the oil zone into the producing wellbore.

The most significant oil recovery problem with heavy oil, tar sands and similar hydrocarbonaceous material is the extremely high viscosity of the native hydrocarbons. The viscosity ranges from 10,000 cp at the low end of the range to 5,000,000 cp at reservoir conditions. The viscosity of steam at injection conditions is about 0.020 cp. Assuming similar rock permeability to both phases steam and oil, then the viscosity ratio provides a good measure of the flow transmissibility of the formation to each phase. Under the same pressure gradient, gaseous steam can therefore flow from 500,000 to 250,000,000 times easier through the material than the oil at reservoir conditions. Because of this viscosity ratio, it is imperative and critical to any recovery application that the steam be confined or limited to an area of the reservoir by a seal. This seal can be physical, hydraulic or pneumatic and essentially must provide a physical situation which guarantees no-flow of any fluid across an interface. This can be implemented by several means. Without this "barrier" the steam will bypass, overrun, circumvent, detour around the cold viscous formation and move to the producer wellbore. This invention addresses and resolves this major obstructive element in heavy oil recovery.

Horizontal wells have played a prominent part in recovery of oil. These wells can be as much as 4 times as expensive to drill as conventional vertical wells, but the increased expenses are offset by the increases in rates of oil production and faster economic returns. Several patents have described various approaches to using horizontal wellbores. The need for horizontal wells requires a more efficient economical and easily deployable system for developing and drilling these wells. This novel utilization proposed herein addresses the needs and teaches a process of horizontal well drilling that is more easily implemented, allows a larger portion of the reservoir to be exposed and allows more oil recovery to occur.

By implementing the new processes which are taught in this application by this invention the oilfield operator can see improved performance, lower costs, better oilfield management, and allow for efficient and orderly development of petroleum resources.

Improvements have been made in enhancing the contact of the steam with the native heavy oil by the introduction of horizontal well technology, which allows greater recovery than with the customary vertical wells. This current invention provides a further extension of the horizontal technology in which a novel drilling methodology is applied to the drilling effort to allow wells of much larger lateral extent, potentially larger diameters and thereby more efficient recovery systems.

Prior Art:

Various methods and processes have been disclosed for recovery of oil and gas by using horizontal wells. There have been various approaches utilized with vertical wellbores, to heat the reservoirs by injection of fluids and also to create a combustion front in the reservoir to displace the insitu oil from the injection wellbore to the production wellbore.

U.S. Pat. No. 3,986,557 claims a method using a horizontal well with two wellheads that can inject steam into a tar sand formation mobilizing the tar in the sands. In this patent, during the injection of the steam it is hoped that the steam will enter the formation and not continue directly down the open wellbore and back to the surface of the opposite wellhead. It is technically difficult to visualize the steam entering a cold highly viscous formation while a completely open wellbore is available for fluid flow away from the formation. Furthermore, U.S. Pat. No. 3,986,557 teaches that the steam is simultaneously injected through perforations into the cold bitumen formation while hot oil is flowing through the same perforations, in the opposite direction through the rock pore structure, against the invading high pressure steam. This situation is not only physically impossible but it thermodynamically impossible for the hot fluid to flow "against the pressure gradient".

U.S. Pat. No. 3,994,341 teaches a vertical closed loop system inside the wellbore tubulars in which a vertical wellbore is used to generate a vertical circulation of hot fluids which heat the wellbore and nearby formation. Hot fluids and drive fluids are injected into upper perforations which allow the driven oil to be produced from the bottom of the formation after being driven towards the bottom by the drive fluid.

U.S. Pat. No. 4,034,812 describes a cyclic injection process where a single wellbore is drilled into an unconsolidated mineral formation and steam is injected into the formation for a period of time to heat the viscous petroleum in the vicinity of the well and causing the unconsolidated mineral sand grains to settle to the bottom of the heated zone in a cavity and the oil to move to the top of the zone.

U.S. Pat. No. 4,037,658 teaches the use of two vertical wells connected by a cased horizontal shaft or "hole" with a flange in the vertical well. This type of downhole flange connection is extremely difficult if not impossible to implement in current oilfield practice. Two types of fluids are used in this patent, one inside the horizontal shaft as a heater fluid and one in the formation as a drive fluid. Both fluids are injected either intermittently of simultaneously from the surface wellheads.

Butler et al in U.S. Pat. No. 4,116,275 use a single horizontal wellbore with multiple tubular strings internal to the largest wellbore for steam recovery of oil. Steam was injected via the annulus and after a soak period the oil is produced from the inner tubing strings.

U.S. Pat. No. 4,445,574 teaches the drilling of a single well with two wellheads. This well is perforated in the horizontal section and a working fluid is injected into the wellbore to produce a mixture of reservoir oil and injected working fluid. Similar to the U.S. Pat. No. 3,986,557 patent it is difficult from a hydraulic point of view to visualize and contemplate the working fluid entering the formation while an open wellbore is available for fluid flow horizontally and vertically out the distal end of this wellbore.

U.S. Pat. No. 4,532,986 teaches an extremely complex dual well system including a horizontal wellbore and a connecting vertical wellbore which is drilled to intersect the horizontal well. The vertical well contains a massively complex moveable diverter system with cables and pulleys attached to the two separate wellheads to allow the injection of steam. This system is used to inject steam from the vertical wellhead into the horizontal wellbore cyclically and sequentially while the oil is produced from the wellhead at the surface end of the horizontal well.

Huang in U.S. Pat. No. 4,700,779 describes a plurality of parallel horizontal wells used in steam recovery in which steam is injected into the odd numbered wells and oil is produced in the even numbered wells. Fluid displacement in the reservoir occurs in a planar fashion.

U.S. Pat. No. 5,167,280 teaches single concentric horizontal wellbores in the hydrocarbon formation into which a diffusible solvent is injected from the distal end to effect production of lowered viscosity oil backwards at the distal end of the concentric wellbore annulus.

U.S. Pat. No. 5,215,149 by Lu, uses a single wellbore with concentric injection and production tubular strings in which the injection is performed through the annulus and production occurs in the inner tubular string, which is separated by a packer. This packer limits the movement of the injected fluids laterally along the axis of the wellbores. In this invention the perforations are made only on the top portion of the annular region of the horizontal well. Similarly the production zone beyond the packer is made on the upper surface only of the annular region. These perforated zones are fixed at the time of well completion and remain the same throughout the life of the oil recovery process.

Balton in U.S. Pat. No. 5,402,851 teaches a method wherein multiple horizontal wells are drilled to intersect or terminate in close proximity a vertical wellbore. The vertical wellbore is used to actually produce the reservoir fluids. The horizontal wellbore provides the conduits, which direct the fluids to the vertical producing wellbore.

U.S. Pat. No. 5,626,193 by Nzekwu et al disclose a single horizontal well with multiple tubing elements inside the major wellbore. This horizontal well is used to provide gravity drainage in a steam assisted heavy oil recovery process. This invention allows a central injector tube to inject steam and then the heated produced fluids are produced in a backwards direction through the annular region of the same wellbore beginning at the farthest or distal end of the horizontal wellbore. The oil is then lifted by a pump. This invention shows a process where the input and output elements are the same single wellbore at the surface.

U.S. Pat. No. 5,655,605 attempts to use two wellbores sequentially drilled from the surface some distance apart and then to have these horizontal wellbore segments intersect each other to form a continuous wellbore with two surface wellheads. This technology, while theoretically possible is operationally difficult to hit such a small underground target, i.e the axial cross-section of a typical 8-inch wellbore using a horizontal penetrating drill bit. It further teaches the use of the horizontal section of these intersecting wellbores to collect oil produced from the formation through which the horizontal section penetrates. Oil production from the native formation is driven by an induced pressure drop in the collection zone by a set of valves or a pumping system which is designed into the internal concentric tubing of this invention. The U.S. Pat. No. 5,655,605 also describes a heating mechanism to lower the viscosity of the produced oil inside the collection horizontal section by circulating steam or other fluid through an additional central tubing located inside the horizontal section. At no time does the steam or other hot fluid actually contact the oil formation where viscosity lowering by sensible and latent heat transfer is needed to allow oil production to occur.

U.S. Pat. No. 6,708,764 provides a description of an undulating well bore. The undulating well bore includes at least one inclining portion drilled through the subterranean zone at an inclination sloping toward an upper boundary of the single layer of subterranean deposits and at least one declining portion drilled through the subterranean zone at a declination sloping toward a lower boundary of the single layer of subterranean deposits. This embodiment looks like a waveform situated in the rock formation.

U.S. Pat. No. 6,725,922 utilizes a plurality of horizontal wells to drain a formation in which a second set of horizontal wells are drilled from and connected to the first group of horizontal wells. These wells form a dendritc pattern arrangement to drain the oil formation.

U.S. Pat. No. 6,729,394 proposes a method of producing from a subterranean formation through a network of separate wellbores located within the formation in which one or more of these wells is a horizontal wellbore, however not intersecting the other well but in fluid contact through the reservoir formation with the other well or wells.

U.S. Pat. No. 6,948,563 illustrates that increases in permeability may result from a reduction of mass of the heated portion due to vaporization of water, removal of hydrocarbons, and/or creation of fractures. In this manner, fluids may more easily flow through the heated portion.

U.S. Pat. Nos. 6,951,247, 6,929,067, 6,923,257, 6,918,443, 6,932,155, 6,929,067, 6,902,004, 6,880,633, 20050051327, 20040211569 by various inventors. and assigned to Shell Oil Company have provided a very exhaustive analysis of the oil shale recovery process using a plurality of downhole heaters in various configurations. These patents utilize a massive heat source to process and pyrolize the oil shale insitu and then to produce the oil shale products by a myriad of wellbore configurations. These patents teach a variety of combustors with different geometric shapes one of which is a horizontal combustor system which has two entry points on the surface of the ground, however the hydrocarbon production mechanism is considerably different from those proposed herein by this subject invention.

U.S. Pat. No. 6,953,087 by Shell, shows that heating of the hydrocarbon formation increases rock permeability and porosity. This heating also decreases water saturation by vaporizing the interstitial water. The combination of these changes increases the fluid transmissibility of the formation rock in the heated region.

Dynatec in Ref. 3 teaches in a coal bed degassing operation the use of a pair of horizontal wellbores connected to a central vertical wellbore which is used to drain gas from coal bed methane formations. The Dynatec methodology is a passive procedure in which gas is drained and where the wellbores behave as extended lateral fractures in which gas flowed into the central zone where gas and water commingled before being lifted to the surface. The Dynatec horizontal wellbores do not appear to extend to and be open to the surface of ground. In addition, in the Dynatec method there is no displacement mechanism to move the petroleum fluid as taught in the subject application of petroleum extraction using horizontal and vertical wellbores.

Patent application 20050045325 describes a recovery mechanism for heavy oil hydrocarbons in which a pair of wells is used. A vertical injector well is horizontally separated from a vertical production well. The hot fluid, steam or air is injected into the bottom portion of the injector and is expected to displace the very viscous immobile oil from the cold reservoir and push this hot oil through the cold oil saturated formation eventually to the producer. The invention expects oil flow to occur by drilling a web or radial channels from the injector to the producer. It is inconceivable that viscous cold oil, or even lower viscosity hot oil will preferably flow along these channels while extremely low viscosity high-pressure steam will flow through the cold formation. Flow mechanics in porous media dictates that hot, saturated steam will completely bypass cold viscous oil and the process will be a quick steam recycle process from injector to producer.

The Society of Petroleum Engineers Ref. 1, SPE paper 2001 7 teaches a computer simulation of a displacement process using a concentric wellbore system of three wellbore elements and complex packers in which steam is injected in a vertical wellbore similar to that in the U.S. Pat. No. 3994341. Simulated steam injection occurs through one tubing string and circulates in the wellbore from just above the bottom packer to the injection perforations near the top of the tar sand. This circulating steam turns the wellbore into a hot pipe which heats an annulus of tar sand and provides communication between the steam injection provides communication between the steam injection perforations near the top of the tar sand and the fluid production perforations near the bottom of the tar sand. This process required 7 years to increase oil production from 20 BOPD to 70 BOPD.

Paper 37115 describes a single-well technology applied in the oil industry which uses a dual stream well with tubing and annulus: steam is injected into the tubing and fluid is produced from the annulus. The tubing is insulated to reduce heat losses to the annulus. This technology tries to increase the quality of steam discharged to the annulus, while avoiding high temperatures and liquid flashing at the heel of the wellbore.

SPE paper 50429 presents an experimental horizontal well where the horizontal well technology was used to replace ten vertical injection wells with a single horizontal well with limited entry. The limited-entry perforations enabled steam to be targeted at the cold regions of the reservoir.

SPE paper 50941 presents the "Vapex" process which involves injection of vaporized hydrocarbon solvents into heavy oil and bitumen reservoirs; the solvent-diluted oil drains by gravity to a separate and different horizontal production well or another vertical well.

SPE paper 53687 shows the production results during the first year of a thermal stimulation using dual and parallel horizontal wells using the SAGD technology in Venezuela.

SPE paper 75137 describes a THAI—'Toe-to-Heel Air Injection' system involving a short-distance displacement process, that tries to achieve high recovery efficiency by virtue of its stable operation and ability to produce mobilized oil directly into an active section of the horizontal producer well, just ahead of the combustion front. Air is injected via a separate vertical or a separate horizontal wellbore into the formation at the toe end of different horizontal producer well and the combustion front moves along the axis of the producer well.

SPE paper 78131 published an engineering analysis of thermal simulation of wellbore in oil fields in western Canada and California, U.S.A.

SPE paper 92685 describes U-tube well technology in which two separate wellbores are drilled and then connected to form a single wellbore. The U-tube system was demonstrated as a means of circumventing hostile surface conditions by drilling under these physical obstacles.

Reference 4 shows conclusively that the gravity drainage effect is the most critical factor in oil recovery in heavy oil systems undergoing displacement by steam.

Very few of these prior art systems have been used in the industry with any success because of their technical complexity, operational difficulties, and being physically impossible to implement or being extremely uneconomical systems.

For example, in U.S. Pat. No. 3,994,341, this embodiment which although on the surface resembles the invention herein differs significantly since, the U.S. Pat. No. 3,994,341 patent forms a vertical passage way only by circulating a hot fluid in the wellbore tubulars to heat the nearby formation, the U.S. Pat. No. 3,994,341 claims the drive fluid promotes the flow of the oil by vertical displacement downwards to the producing perforations at the bottom. The U.S. Pat. No. 3,994,341 teaches the production perforations are set at the bottom of the vertical formation, a distance which can be several hundred feet in real field cases.

First, in this U.S. Pat. No. 3,994,341 embodiment, since no control mechanism like a back pressure system or pressure control system is taught, it is obvious that the high pressure drive steam, usually at several hundred psi, will preferentially flow down the vertical passageway immediately on injection and bypass the cold formation with its highly viscous crude and extremely low transmissibility. Secondly, the large distance between the top of the formation and the bottom of the formation will cause condensation of the drive steam allowing essentially hot water to be produced at the bottom with low quality steam, both fluids being re-circulated back to the surface. In addition, the mechanism to heat the near wellbore can only be based on conductive heat transfer through the steel casing. There is ineffective heat transfer since there is no direct steam contact with the formation rock in which latent heat transfer to formation fluids and rock can occur, this latent heat being the major heat transport system. The U.S. Pat. No. 3,994,341 process is incapable of delivering sufficient heat in a reasonable time to heat the formation sufficiently to lower the viscosity of the oil, raise the porosity and permeability of the formation as taught in the present patent application.

There is a long felt need in the industry for a means of moving the heated low viscosity crude oil that has been contacted by the steam in the steam zone to a place or location where it can be produced without having to move it through a cold heavily viscous oil impregnated formation. This problem has continued to baffle the contemporary and prior art with possibly the only exception being the SAGD patent which uses two horizontal wells closely juxtaposed in a vertical plane. Even this SAGD approach has inherent difficulties in initiating the hot oil flow between the two wellbores. Trying to push the hot oil through a cold formation is an intractable proposition. The subject invention offers a solution to this need and provides the mechanism by which the solution can be implemented using conventional equipment and procedures.

Shortcomings of prior art can be related to a combination of effects. These include;

(1) the inability of the process to inject the hot fluid into and across the length of a cold highly viscous oil formation with limited conductivity due native oil viscosities in excess of $10^6$ Cp.

(2) the viscosity of steam is less than 0.020 cp under the reservoir conditions which makes the flow of steam through porous media 5,000,000 times easier than cold high viscosity oil of 100,000 cp. This flow ratio is based directly on the viscosity ratios.

(3) the inability of the methods to prevent steam bypass, without some type of seal mechanism, of this extremely highly mobile injected fluid directly from the injector source towards the producing sink.

(4) the inability of the method to form and maintain a viable communication zone from the steam zone or chamber to the producing sink while preventing bypass and early breakthrough of steam.

(5) the inability of the process to utilize the gravity drainage effects created by the low density of the hot steam compared to condensed water and hot oil.

(6) the inability of the process to heat the formation effectively by physical contact between the steam and the rock formation such that latent heat, the major source of steam heat energy, can be transferred to the rock and hydrocarbons efficiently.

(7) the requirement of long lead times of months to years of hot fluid injection, before there is any production response of the displaced oil.

(8) finally the use of overly complex equipment of questionable operational effectiveness to implement the process in the field.

THIS NEW INVENTION provides an improvement in the method whereby the operator drills a specially designed and under-reamed vertical well to form a central production cavity; and a plurality of horizontal wells, which are drilled from the surface down to the producing formation, and laterally to intersect the central cavity. In one embodiment, the lateral wellbore is continued drilling upwards to the surface to form a uniwell™. In this embodiment, this continuous uniwell™ behaves as a single well with two wellheads. The additional implementation is the development of a central collection cavity into which the hot displaced oil is allowed to drain from the lateral horizontal wells in to the central collection cavity. A producing mechanism including pumping equipment lifts the produced oil from the central cavity to the surface. The techniques proposed herein use a combination of drilling activities that are known separately and distinctly in the industry, but have not yet been utilized in this integrated manner shown in this new invention.

SUMMARY OF THE INVENTION

An object of this invention is to provide an improved process for recovery of heavy oils and similar hydrocarbons from subterranean formations by exploiting the advantages provided by gravity drainage in the displacement process of heavy oils in porous formations using steam or combustion driven displacement processes. The use of a modified single well bore, with a downward, lateral and upward section, the uniwell™, along with a collection cavity connected to a producer well system, has several engineering benefits including cost reduction, better fluid displacement and more engineering control and economic recovery of the injection and oil recovery process.

Another specific objective is to provide a means whereby the same wellbore perforations along the horizontal section of the wellbore can be used sequentially for either injection or production as required by the operator.

Another specific objective is to use the movable packer between the injection and production perforations, which forces the steam to exit the wellbore and enter the oil zone at a preset location upstream of the production perforations.

Another specific objective is that after the initial oil region is depleted, to unseat and move the movable packer between the injection and production perforations a preset distance along the axis of the wellbore and reseat it to allow the steam displacement process to continue throughout the reservoir in a new undepleted oil zone.

Another specific objective is to provide a means to considerably reduce the distance the heated oil has to move from the steam injection point to be produced in the wellbore through the producing formations.

Another specific objective is to provide a concentric communication channel in the formation, which allows the heated oil to move from the upper steam zone to the perforations in the lower production zone.

Another specific objective is to provide a means whereby oil production begins as early as possible during the injection process compared to existing technologies like Steam Assisted Gravity Drainage (SAGD) and conventional Thermal Enhanced Oil Recovery (TEOR).

Another specific objective is to allow the steam to replace oil and to pressure up the steam bank at the top, which helps to displace low viscosity, heated oil downwards along the interface of steam/cold reservoir oil to the producing perforations where there exists a pressure sink because oil is being removed during production.

Another specific objective is to use the accumulated oil in the lateral and upward portion of the wellbore to act as an U-tube device, which behaves similarly to a P-trap in a household drain, allowing the steam to remain on the injector side of the wellbore and maximize growth of the steam zone in the reservoir where it is more effective.

Another specific objective is to use the produced oil, which accumulates in the lateral and upward portion of the wellbore to act as a backpressure system such that the steam bank is prevented from break through by flowing down the wellbore.

Another specific objective is to use the bottom hole pump and by controlling surface production rates thereby allowing the reservoir pressure to be maintained at a level such that no steam is produced because of the back pressure in the production wellbore.

BRIEF DESCRIPTION OF THE DRAWINGS

The present invention consists of the wellbore and associated components shown in the figures below.

DESCRIPTION OF ITEMS

| No | Description |
|---|---|
| 1 | Surface of ground |
| 2 | Central producer wellbore |
| 3 | Cavity below central wellbore |
| 4 | Uniwell Wellbore |
| 5 | Hydrocarbon bearing formation |
| 6 | Underburden Formations |
| 7 | Overburden formations |
| 8 | Entry wellhead |
| 9 | Downward section of wellbore |
| 10 | Lateral section of wellbore |
| 11 | High transmissibility heated annular zone |
| 12 | Hot oil |
| 13 | Downhole Pump |
| 14 | Downhole pressure regulator device |
| 15 | Well Casing |
| 16 | Well Perforations for fluid injection |
| 17 | Well Perforations for oil and water production |
| 18 | Wellbore movable packer |
| 19 | Wellbore movable downhole heater |
| 20 | Steam bank or steam chamber |
| 21 | Oil production tanks |
| 22 | Steam |
| 23 | Well 4-spot pattern |
| 24 | Steam Generator |
| 25 | Unswept formation zone |
| 26 | Annular communication or reamed zone |
| 27 | Oil flow direction |
| 28 | Successive zones of steam growth |
| 29 | Horizontal Fluid level in cavity and wellbores |
| 30 | Combustion front |

-continued

| No | Description |
|---|---|
| 31 | Flow Direction of Injected Air |
| 32 | Power Cable to Heater |
| 33 | Injected Air zone |
| 34 | Steam injection time. |
| 35 | Steam soak time |
| 36 | Oil Production rate decline curve |
| 37a | Oil Production cycle period. |
| 37b | Oil Daily production rate |
| 37c | Well Shut-in period, zero production rate |
| 38 | Wellbore heating period. |
| 39 | Oil flow rate increase trend |
| 40 | Oil flow rate decreasing trend. |

DETAILED DESCRIPTION OF THE PROPOSED INVENTION

Figure 1:
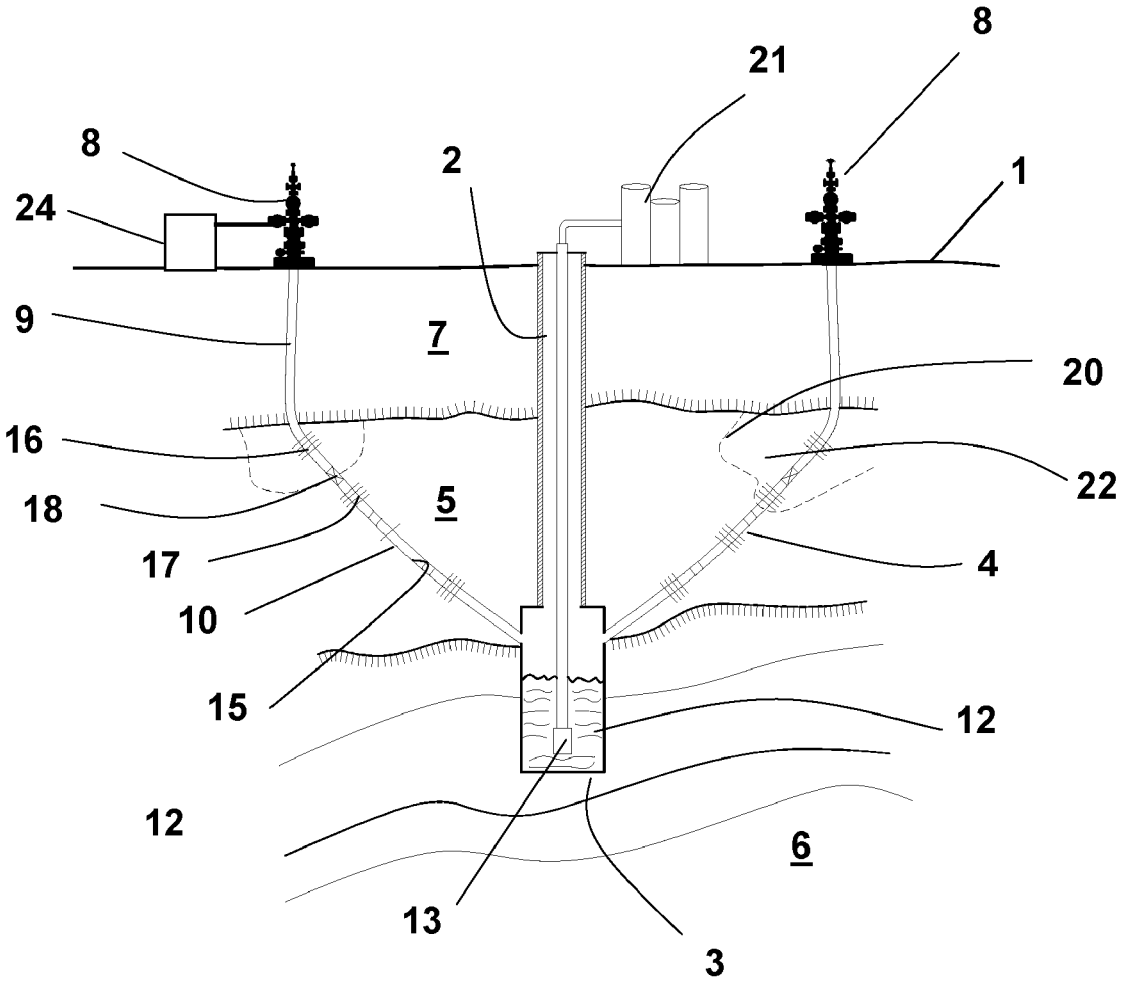
FIG. 1 Shows an overview of the uniwell™ system with the downward, the horizontal lateral and the part of the upward sections of the wellbore and the central collection cavity in the producer well system.
Figure 10:
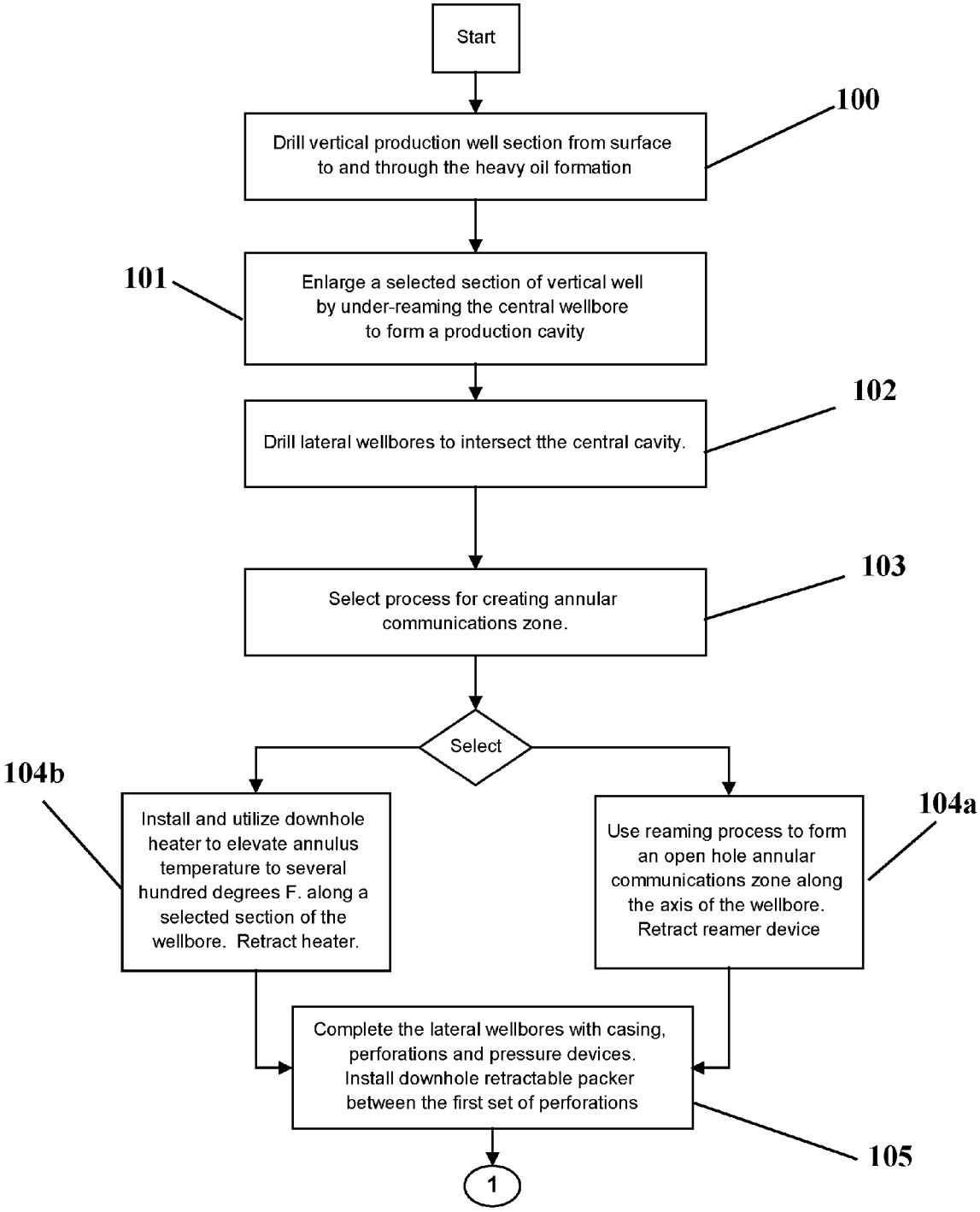
FIG. 10 Shows a block diagram of the operational aspects of the invention.
Figure 11:
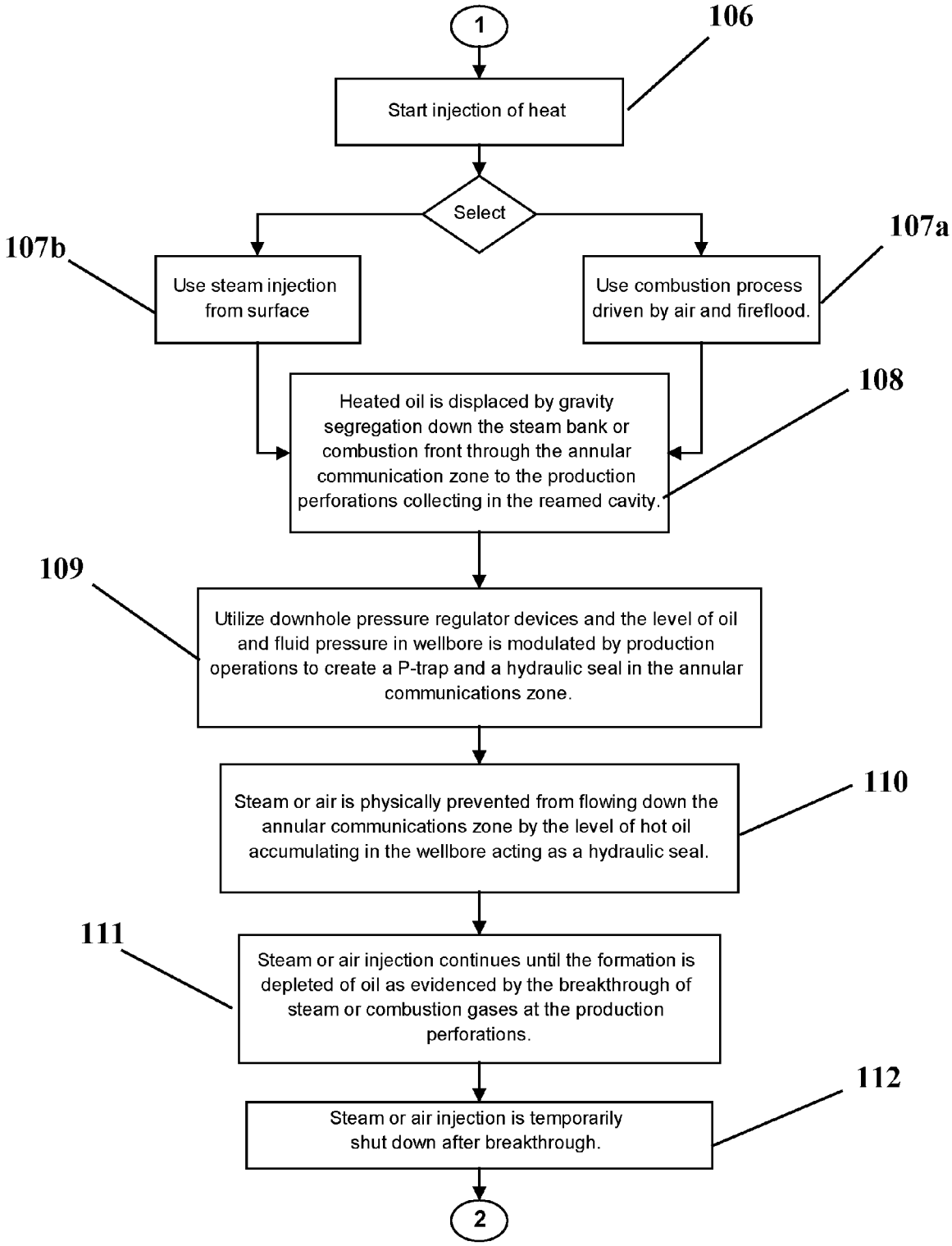
FIG. 11 Shows a block diagram continuing the operational aspects of the invention.
Figure 12:
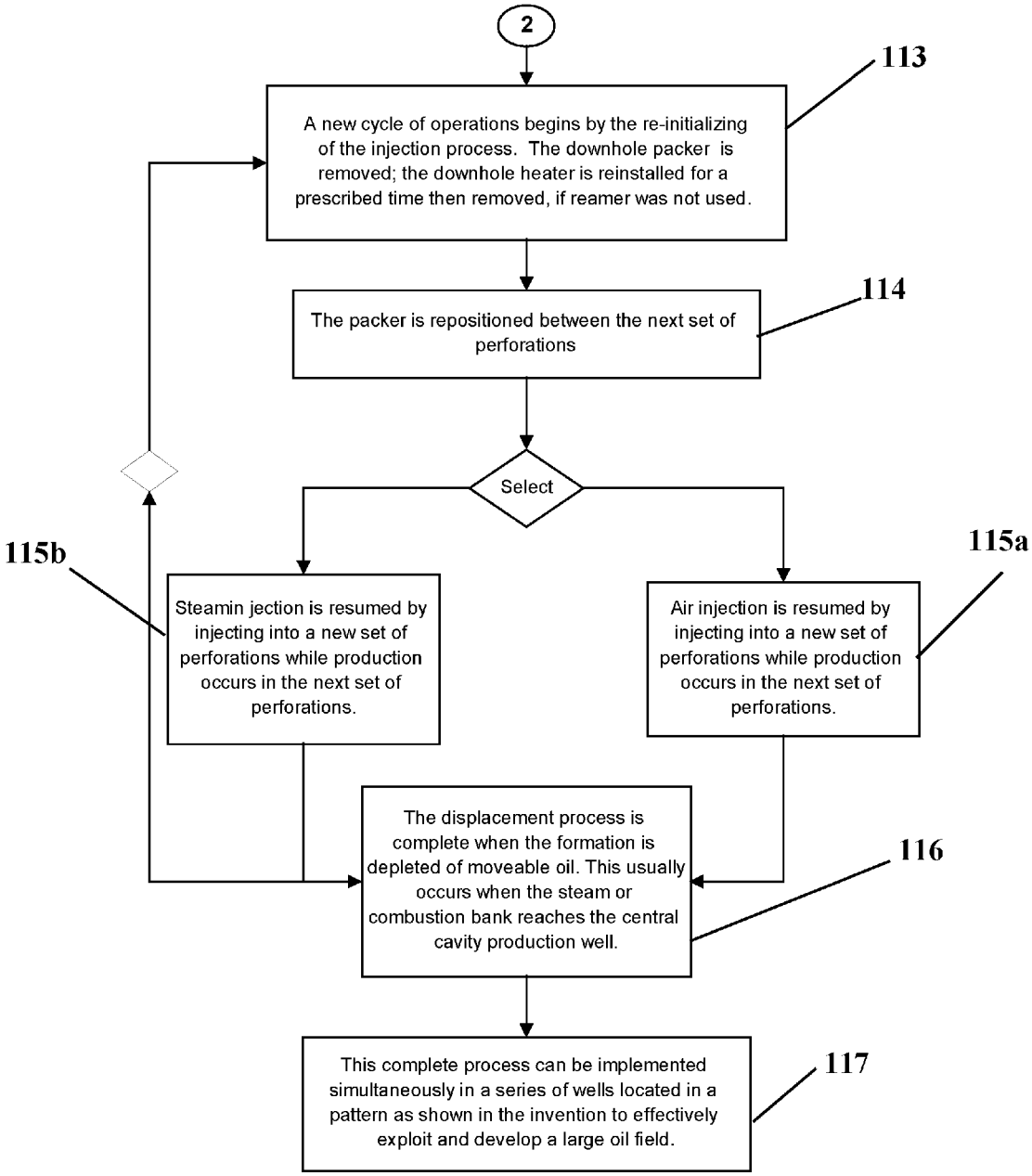
FIG. 12 Shows a block diagram continuing the operational aspects of the invention.

Referring now to the drawings the new invention process is described as follows. Referring to FIG. 1 and FIG. 10, a central wellbore 2 is drilled from the surface of the ground 1 down to and passing through the hydrocarbon bearing formation 5 as shown in step 100. The central wellbore is under-reamed by using a reamer tool to provide a large cavity 3 up to as much as 8 feet in radius and several feet deep as indicated in step 101. Oilfield tools provided by Ref. 2. are capable of performing this operation routinely. After the central well 2 is drilled and under-reamed it forms a production cavity 3 at its bottom. This production cavity can hold several hundred barrels of hot oil and condensed water. For example., a 6-foot radius cavity that is 20 feet high can hold in excess of 1,000 barrels of fluid. This volume can be about a one-week fluid production volume from a typical shallow stimulated steam well. As shown in step 102 a series of uniwells 4 are drilled from the surface vertically downwards, then laterally through the hydrocarbon pay zone at a specified angle to intersect the production cavity 3 in the central wellbore 2. This uniwell 4 can terminate in the cavity 3 or in another embodiment, it can continue upwards to the surface of the ground 1 to form a separate wellhead 8.

Figure 2:
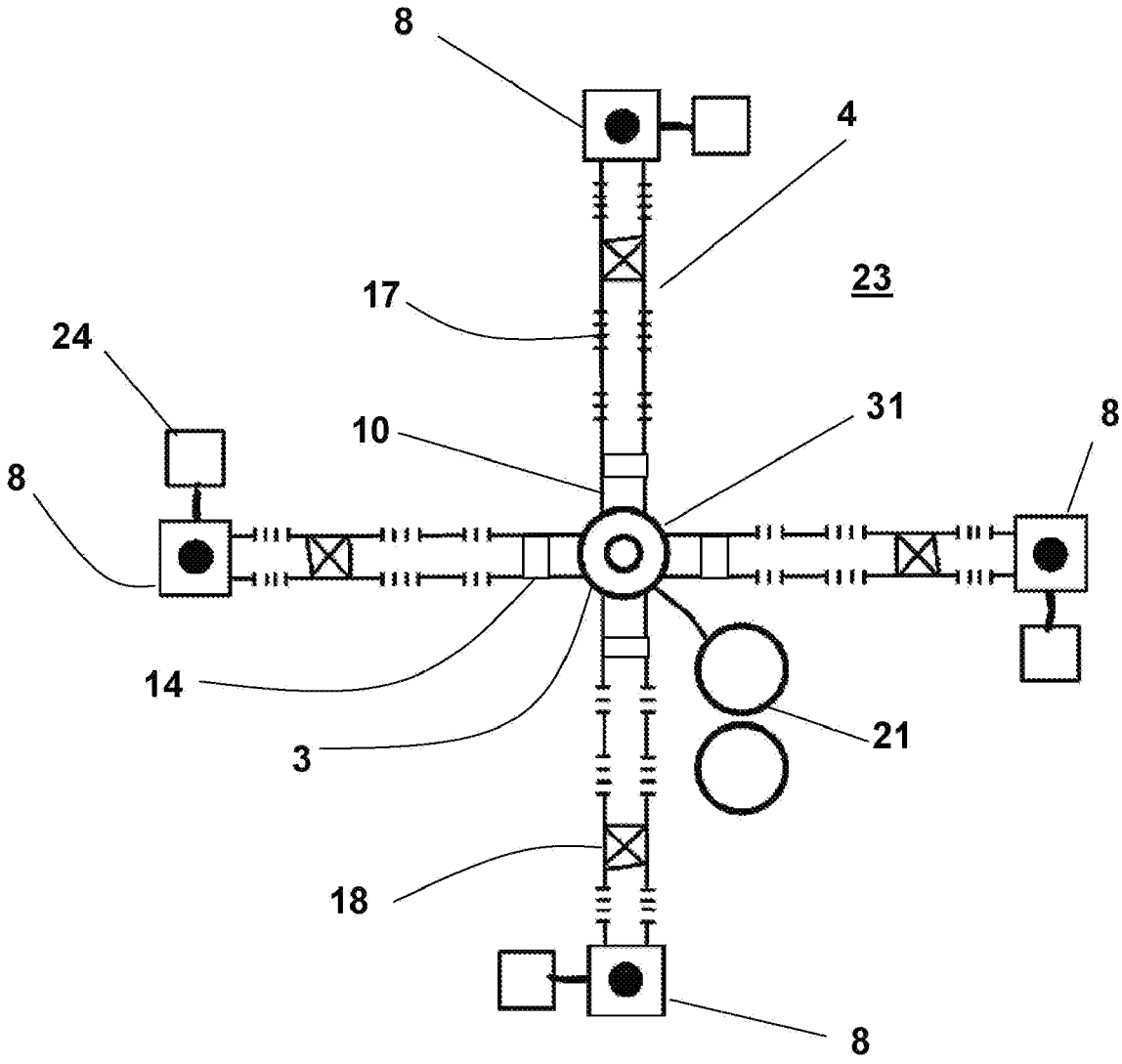
FIG. 2 Shows a plan view, looking top-down, with 4 well segments (2 uniwells) and a central producer well over the collection cavity.
Figure 3:
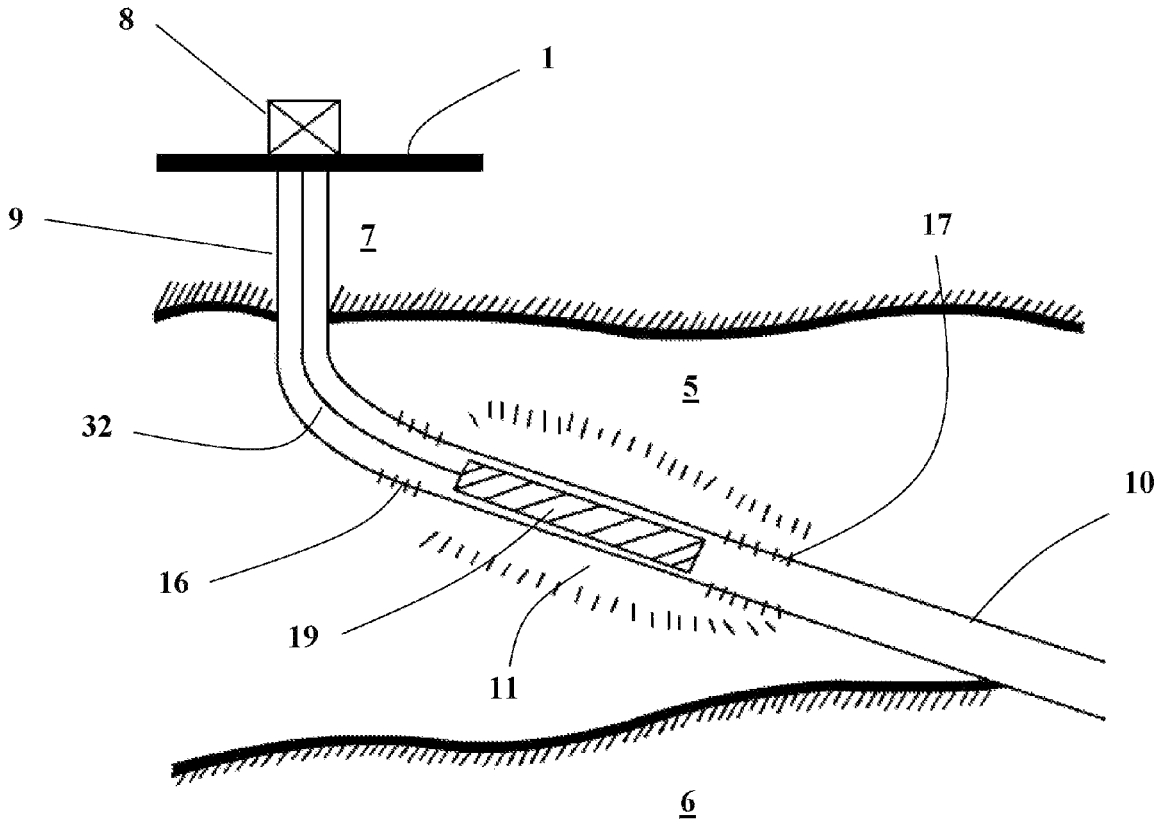
FIG. 3 Shows the use of the downhole heater in one embodiment to heat up the near wellbore zone initially in the segment between the injector and producer so that a communication annulus which allows hot mobile oil to move preferentially from the heated zone to the producing perforations.
Figure 4:
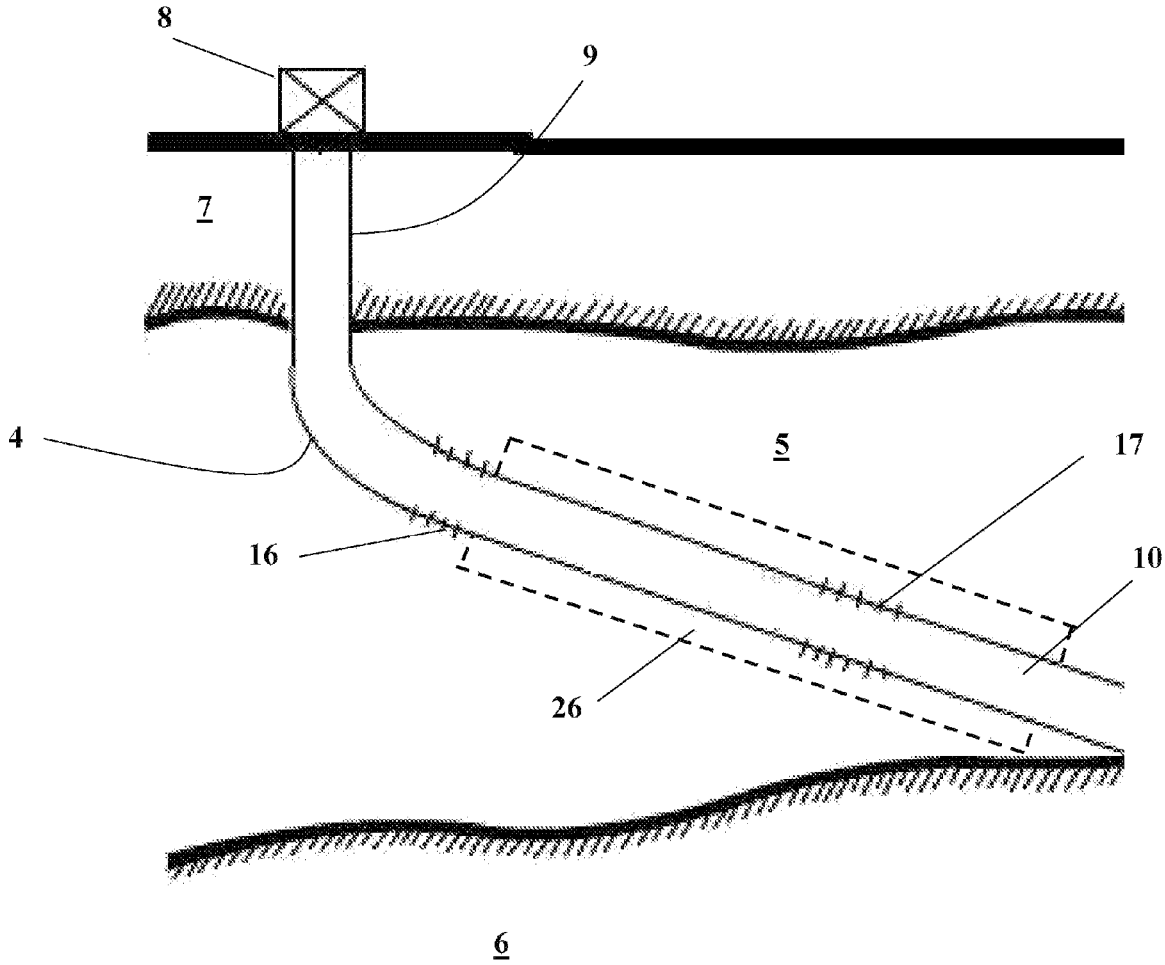
FIG. 4 Shows an embodiment in which the reamed out annular zone around the lateral wellbore provides a flow path from the injector perforations to the producer perforations.
Figure 5:
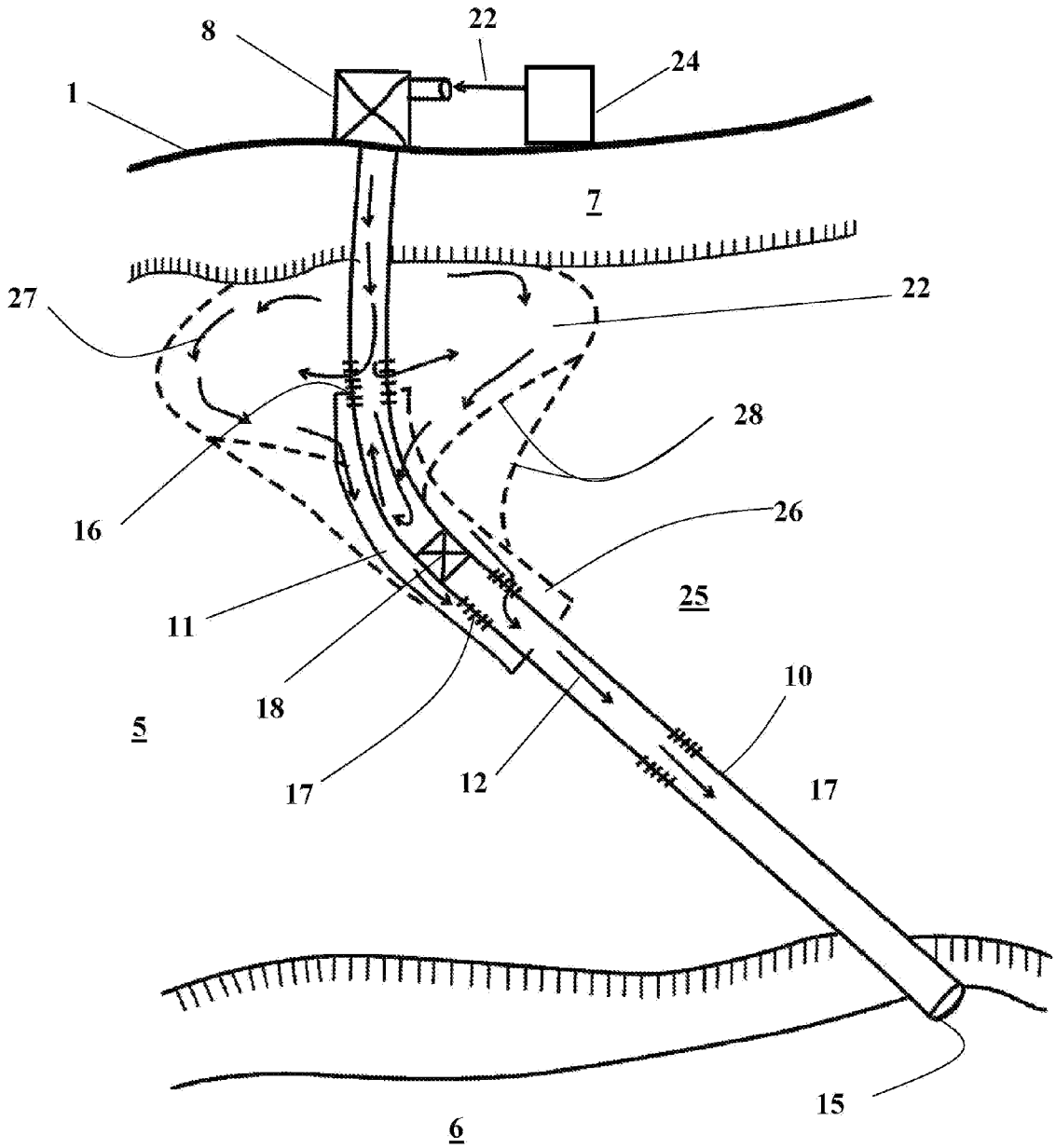
FIG. 5 Shows the cross-section (side view) of the elevated temperature cavity or steam cavity or chamber which develops in the porous formation as steam is injected into the cold medium. The oil being heavier and now mobile by being heated flows down the "walls" of the chamber and towards the bottom of the formation and enters the lower production perforation zone via the communication zone between the injector and producer perforations. The words bank, chamber and chamber are to be used interchangeably in this application.

Another embodiment described herein involves the drilling of separate multiple uniwells 4 from the surface to intersect and terminate in the central cavity 3 as shown in the well pattern of FIG. 2. These uniwells 4 are perforated at predetermined locations 16, 17, along the well casing 15. In other embodiments an "open-hole" completion can be used in which there is no steel casing in the wellbore. This can be done in well-consolidated rock formations but it is not a recommended approach for steam injection operations. These perforations become production perforations 17 or injection perforations 16 depending on the timeline of the oil recovery process and their relation to the location of the downhole packer 18. In an "open hole" completion, this packer 18 can be a retractable inflatable packer in those situations where the well is completed without a casing 15. Downhole pressure regulators 14 are installed in the distal section of the uniwell 4 before the entrance into the central production cavity 3. In one embodiment, as shown in steps 103, 104*b*, a removable downhole wellbore heater 19 as shown in FIG. 3, is installed in the uniwell lateral section at a point between the first injection perforations 16 and the first set of production perforations 17. This heater is turned on in step 104*b* and allowed to heat the wellbore 4 and the near wellbore formation 5 to a high enough temperature, in the range of 300 deg. F. to 600 deg F., to significantly modify this annular region 11 to form a high transmissibility conduit through which hot oil from the steam displacement process will preferentially flow. The heater 19 is removed after the heat cycle of at least 24 hours is completed. A retractable downhole packer 18 is then installed between the injection perforation 16 location and the production perforations 17 as shown in step 105. Another embodiment involves using a reaming bit as shown in step 104*a* to form a reamed out annulus 26 enlarging the lateral wellbore 4 as shown in FIG. 4.

Figure 6:
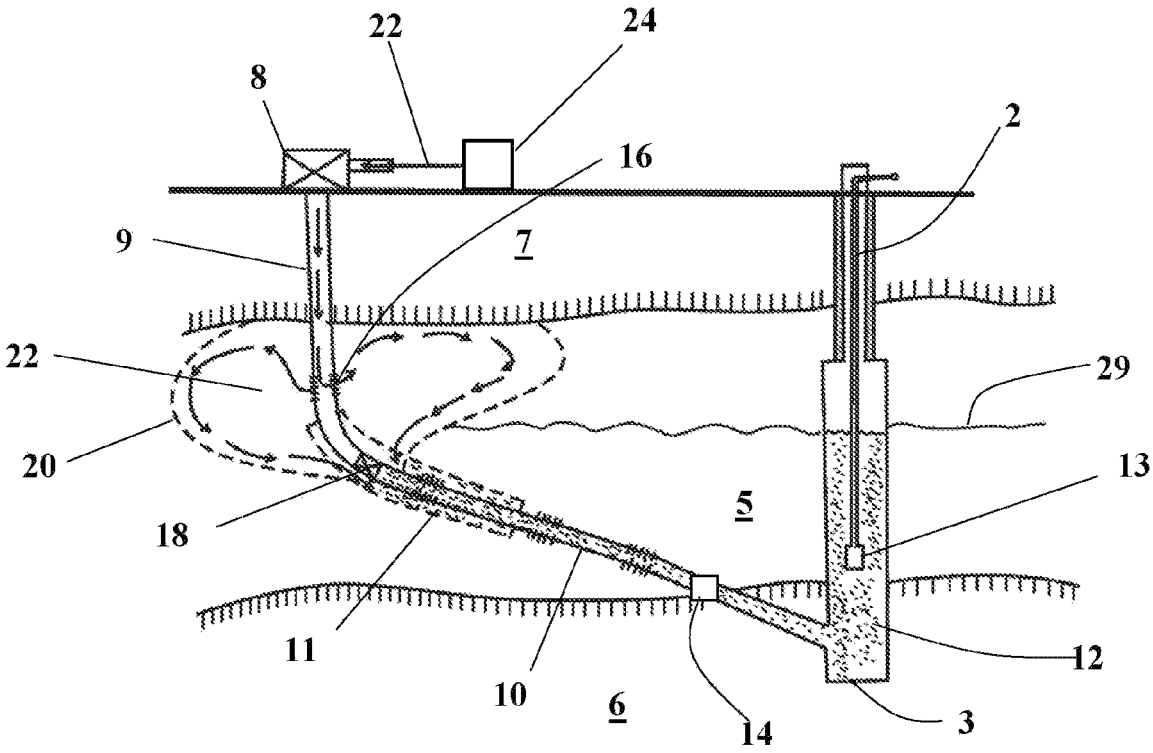
FIG. 6 Shows the cross-section (side view) of the steam cavity, central wellbore, central cavity and lateral wellbore in which accumulated hot oil and condensed steam (water) behave as a hydraulic plug to maintain an effective seal preventing the steam bypass and production into the production perforations.
Figure 7:
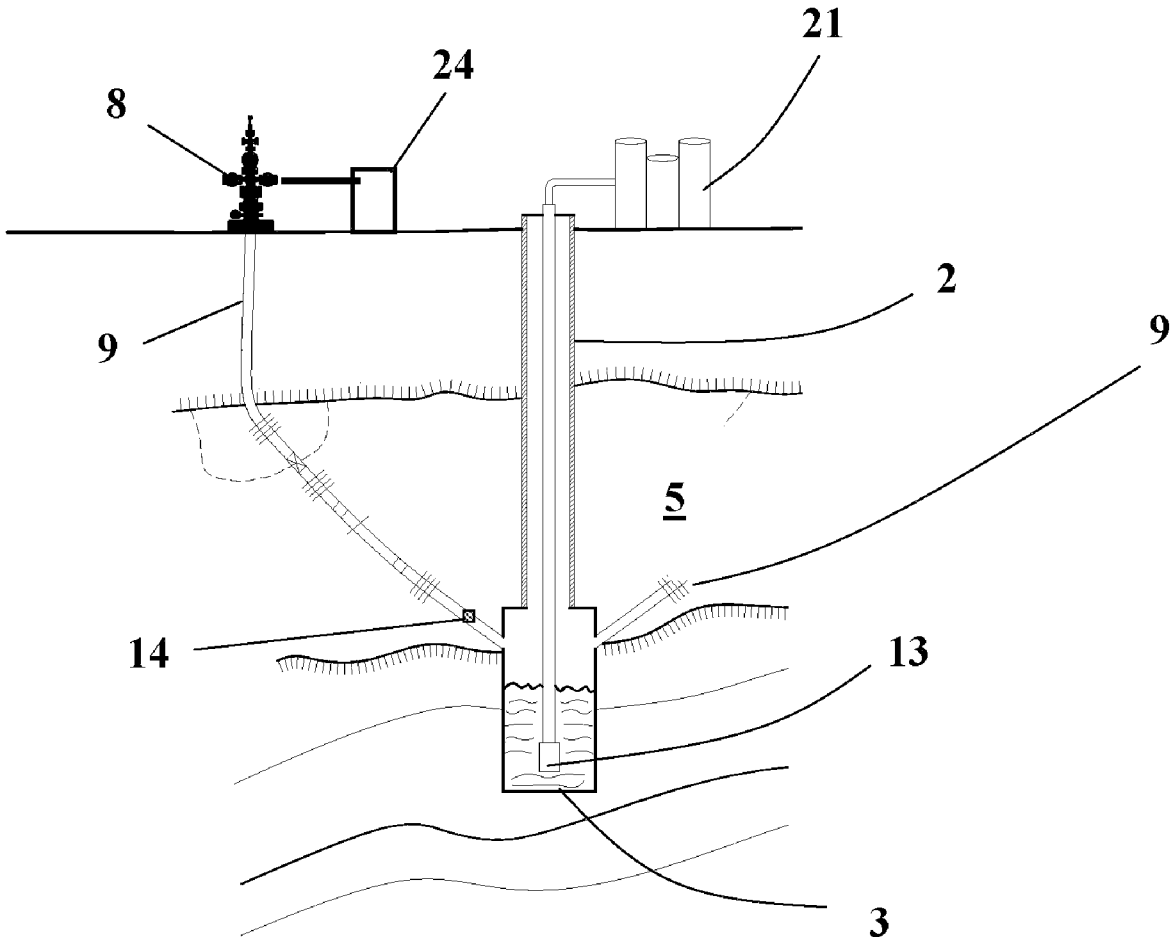
FIG. 7 Shows an active pressure control system in the lateral wellbore using downhole pressure regulators.

As shown in step 106 and 107*b*, steam is generated on the surface by any of several available thermal methods, these include among others, steam boilers, steam generators coupled to electrical cogeneration systems which use the power plant exhaust gas as a source of heat. The steam 22 under pressure is injected from the surface down the uniwell wellbore 4 and on meeting the packer 18 it is forced into the formation 5 through the injection perforation 16. The steam forms a steam bank 20 which heats up the native oil, considerably lowering its viscosity, displaces the oil and because of gravity segregation as indicated in step 108, the oil flows downwards in the steam bank or steam chamber 20 as shown in FIG. 6. The steam bank or steam zone 20 is a heated zone in the formation 5 in which the pore spaces of the rock are filled with injected steam 22, condensed hot water and hot oil 12. There may also be some hydrocarbon gas distributed in this zone. Gravity effects cause the steam gas to inhabit the top sections and the oil and water segregate and collect at the bottom of the zone.

As the steam zone grows, the fluid pressure increases in the steam zone and flow is actively controlled by the pressure regulator 14 which keeps a back pressure on the flow system shown by step 109 such that there is no bypass of steam from the steam chamber 20 downwards into the production perforations 17. All of the steam is thus forced to penetrate the formation and because of the density differences, it accumulates in upper the region of the steam chamber 20 with condensed water and oil 12 in the bottom. The hot oil 12 behaves as a P-trap as shown in FIG. 6 forming a hydraulic seal keeping the oil at the bottom of the steam chamber column and in the annular high transmissibility conduit 11. The height of the oil column can be modulated by fluid production to maintain a viable hydraulic P-trap as shown later. In another embodiment, the central wellbore segment 2 can be pressured from the surface with natural gas or some inert gas to help implement the "P-trap" effect pneumatically in addition to hydraulically.

The hot oil 12 flows downwards as indicated in step 108 under the simultaneous effects of steam driven pressure and gravity forces to the production zone perforations via the communication annulus 11 initially developed in step 104*b* in the heated porous media or through the reamed annulus cavity developed in step 104*a*, around the wellbore 4. The pressure regulator 14 maintains a sufficient backpressure such that the hot oil 12 in the wellbore 4 behaves as a hydraulic seal and the steam 22 preferentially moves into the porous media instead of axially down the wellbore 4. Oil production is allowed into the cavity when the regulator 14 releases the oil flow based on predetermined pressure levels set from a zero pressure value to some finite pressure value. In another embodiment of the process, hot oil and hot water from the condensed steam is allowed to accumulate in the central production cavity 3, the central wellbore 2 and the lateral wellbore 4 as shown in FIG. 6. This liquid column creates a hydraulic seal which maintains an effective barrier at a certain vertical level which prevents the steam from bypassing and increases the steam injection efficiency in the displacement process in the formation. As the cavity 3 fills up the downhole pump 13 initiates lifting of the displaced oil 12. When the first production zone between the injection perforations 16 and production perforations 17 is depleted as evidenced by steam breakthrough at the production perforations and subsequently at the central production cavity during a production cycle, the steam 22 injection is curtailed as indicated in step 111 and the wellbore packer 18 is moved down the wellbore 4 to be reset between the next pair of injection perforations 16 and production perforations 17. In one embodiment as shown in step 113, the downhole packer 18 is retracted to the surface, the downhole heater 19 is replaced at a further distance down the wellbore 4 and a new annular region 11 is heated for the prescribed time. The heater 19 is removed, the packer 18 is replaced and the steam 22 injection is recommenced in the wellbore 4. In the other embodiment, wherein a reamed out annulus 26 is the communication channel the hot oil 12 and condensed water flow down the annulus to the production perforations 17.

FIG. 4 shows another embodiment of the invention in which a section of the wellbore is reamed out during the drilling process to make a large annular zone section 26. This annular cylinder 26 around the wellbore forms the communication zone of infinite conductivity, through which the produced fluids move from the steam zone to the production zone. The steam 22 is injected down the wellbore 4; the wellbore packer 18 diverts the steam into the cold formation 5 where a steam chamber 20 develops. The formation oil is heated by the steam and flows down the steam chamber under gravity towards the bottom of the steam chamber. The produced oil and condensed steam flow down the reamed out zone 26 towards the bottom of the wellbore. In this embodiment, the produced fluids accumulate in the lateral wellbore 4 and fill the production cavity 3.

Figure 9:
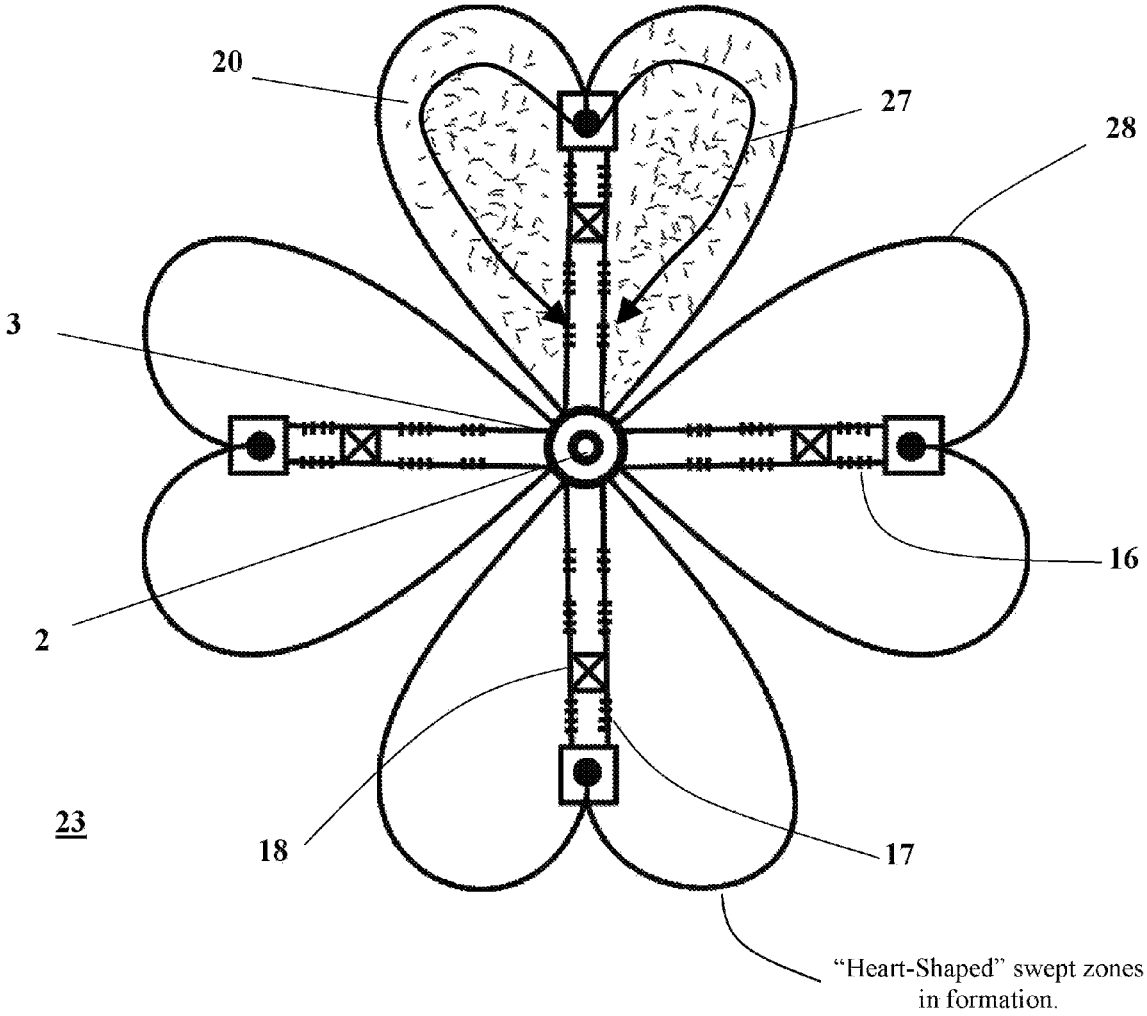
FIG. 9 Shows the well pattern distribution around a central cavity producer well in which four injector-producer wells are located at equally spaced 90° angles and the expected sweep patterns for the steam displacement. This is a similar well pattern as shown in FIG. 2. In practice, these wells can be as many as needed to drain the areal zones effectively and as many an nine wells can be used around a single central producer cavity well.

In one embodiment, the phase sequence of the downhole wellbore heating, packer placement, steam injection and oil production forms a 4-cycle operation which significantly depletes a segment of the underground reservoir. This operational cycle is repeated several times as needed to fully deplete the hydrocarbon formation 5 as shown in steps 113 to 116. The process is complete when the formation is depleted and the last production zone is left at residual oil saturation. The multi-segment well system 4 with the central producer 2 with cavity 3 form a well pattern or well template shown in FIG. 2 which is replicated across a field to completely drain and produce as much oil as possible from the oil field. When the "heart-shaped" swept area behind the steam bank 20 shown in FIG. 9 is completely depleted of movable oil, the injection process is terminated.

In the specific embodiment wherein a reamed annular zone is implemented in the lateral section of the wellbore, since there is no heater 19 used in implementing the annular communication zone 26, the packer 18 is moved axially down the lateral wellbore 4 and the injection-production processes re-initiated.

Figure 8:
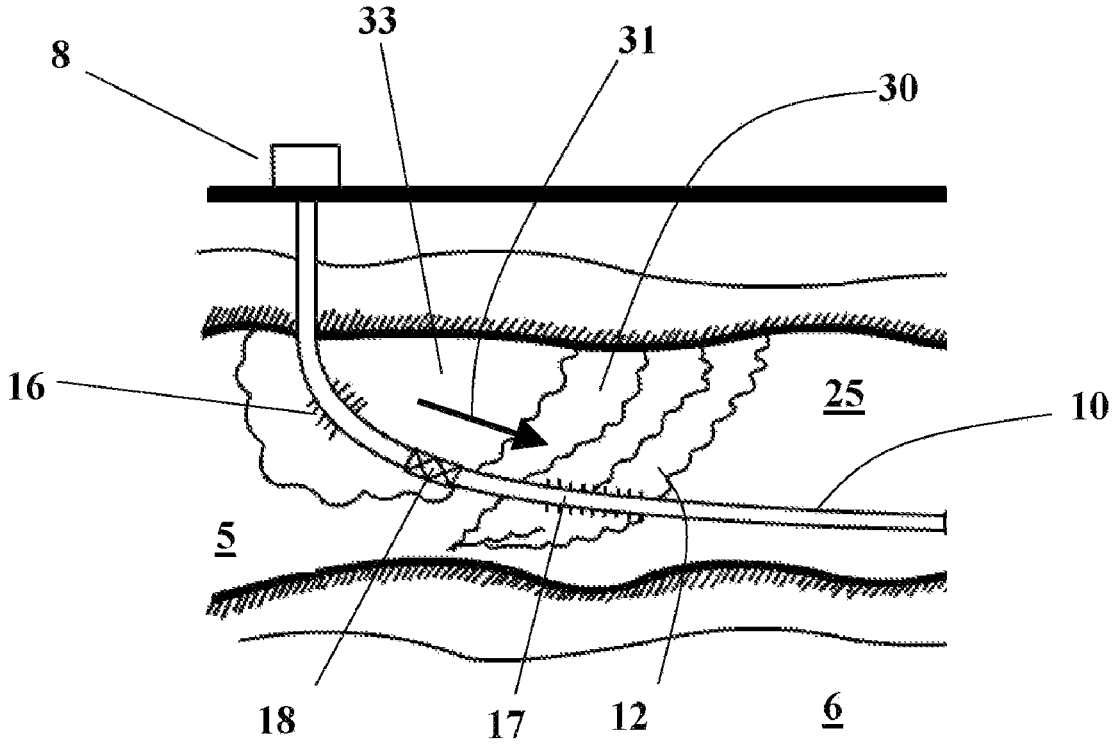
FIG. 8 Shows the combustion front used as a heat source in the invention.

In a still further embodiment of the invention as shown in FIG. 8, a combustion front 30 is initiated in the underground formation 5 by injecting air into the hydrocarbon zone as shown in step 107*a*. The combustion zone provides the heat energy needed to heat the formation and lower the viscosity of the native interstitial oil 12 which flows down the combustion front 30 and is collected in the central production cavity 3. The air injection perforations and oil production perforations are similarly moved axially down the wellbore in a manner analogous to the steam injection process.

In engineering the steam injection operation, a computer program or simulation analysis is routinely used in the industry to calculate the optimal required injection time of steam into the hydrocarbon bearing formation for optimal oil recovery. This analysis incorporates steam flow rate, steam quality, steam pressure, formation rock properties, oil saturation and depth of formation from the surface.

In this invention, during the earliest steam injection time only, the production of hot oil is maintained at zero to allow the oil to accumulate in (a) the bottom of the steam bank 20, (b) in the vertical communication zone 26 and (c) in the wellbore segment 4. This accumulated hot oil 12 behaves as a hydraulic seal preventing steam from bypassing the formation and flowing into the wellbore. In alternative embodiments, the backpressure system described herein prevents the production of oil into the wellbore. These no-flow embodiments are essential and by preventing oil flow, they allow a steam bank to grow since the injected steam is forced to enter the formation directly heating the rock and in-situ hydrocarbons.

After the requisite injection time, as determined by the engineering analysis, which time is nominally a matter of days, the production of hot oil 12 and condensed water is initiated by permitting the removal of hot fluids from the wellbore via the production system or by lowering the backpressure on the fluid column in the wellbore. After the production of accumulated hot oil is complete as evidenced by the incipient flow of dry steam detectable at the surface, the fluid production is shut down and the accumulation of hot oil and condensed water at the bottom of the steam bank resumes. It should be noted that in this invention, except as noted later, steam injection is a continuous operation and the oil production phase is started and stopped at specific operational conditions during this thermal recovery process.

This invention differs significantly from the prior art in its implementation in the field. The ability of the well to be produced very soon after steam injection begins, allows oil revenue to begin almost immediately. Furthermore the volumetric flow rate of oil remains relatively constant while the steam bank is growing and can even increase as cumulative steam injection occurs. This is due to the larger volume of rock being contacted and heated thus lowering the oil viscosity and also by increasing the vertical extent of the steam bank, the gravity effect on the oil flow column is increased, both results contribute to increased oil flow rates.

Figure 13:
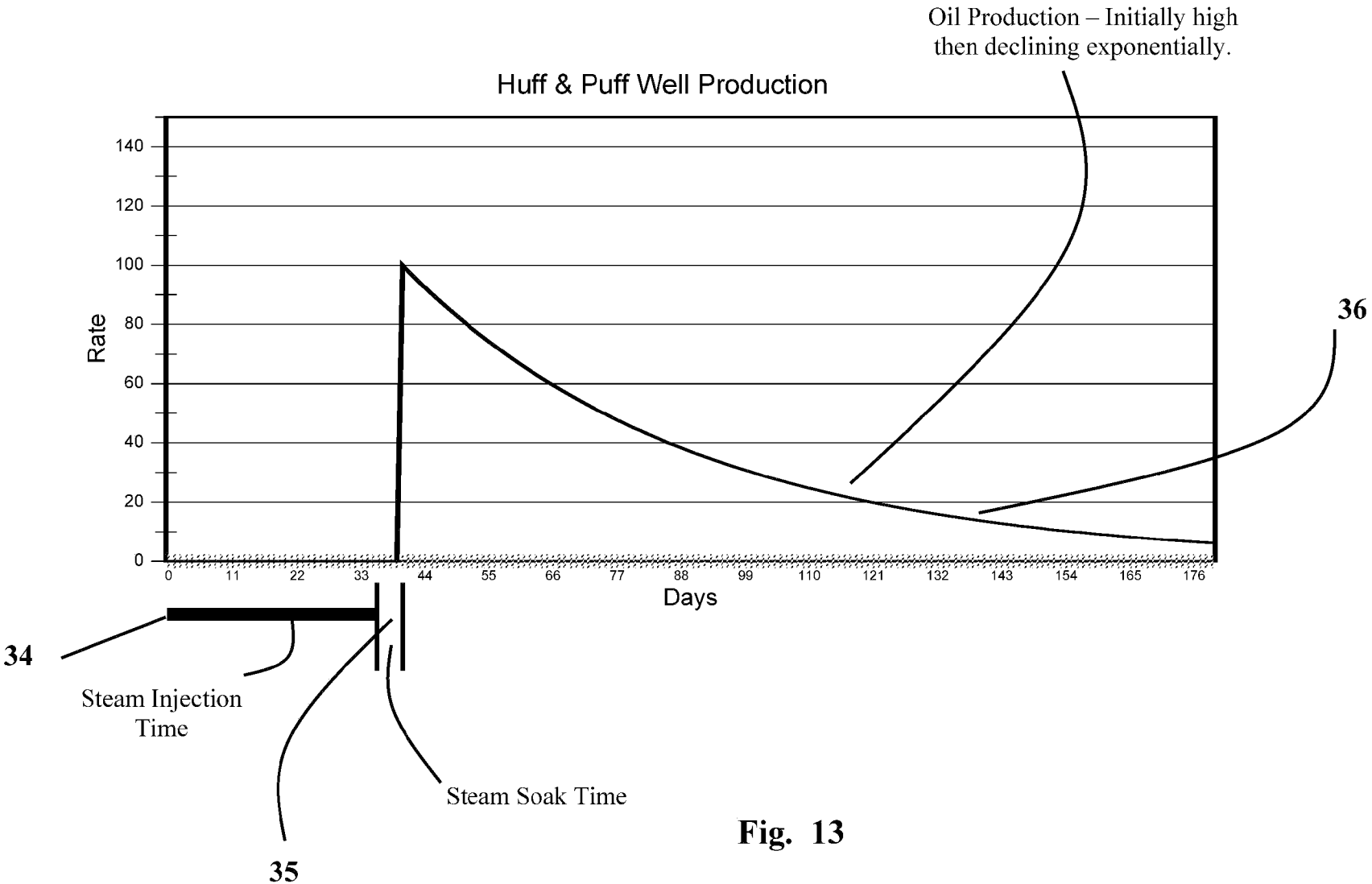
FIG. 13 Shows the graph of production during a typical operation of the prior art in which a "huff and puff" steam field operation is implemented.

A typical response of a steam heated heavy oil reservoir using the prior art of huff and puff operations is shown in FIG. 13. It should be noted that after the steam injection time 34, steam injection is curtailed and after the soak time 35, the well is put on production as shown in curve element 36. There is an initial increase in oil production rate which immediately declines exponentially to the un-stimulated level after a number of days. This process is repeated several times to fully develop the steam operations and deplete the oil reservoir.

Figure 14:
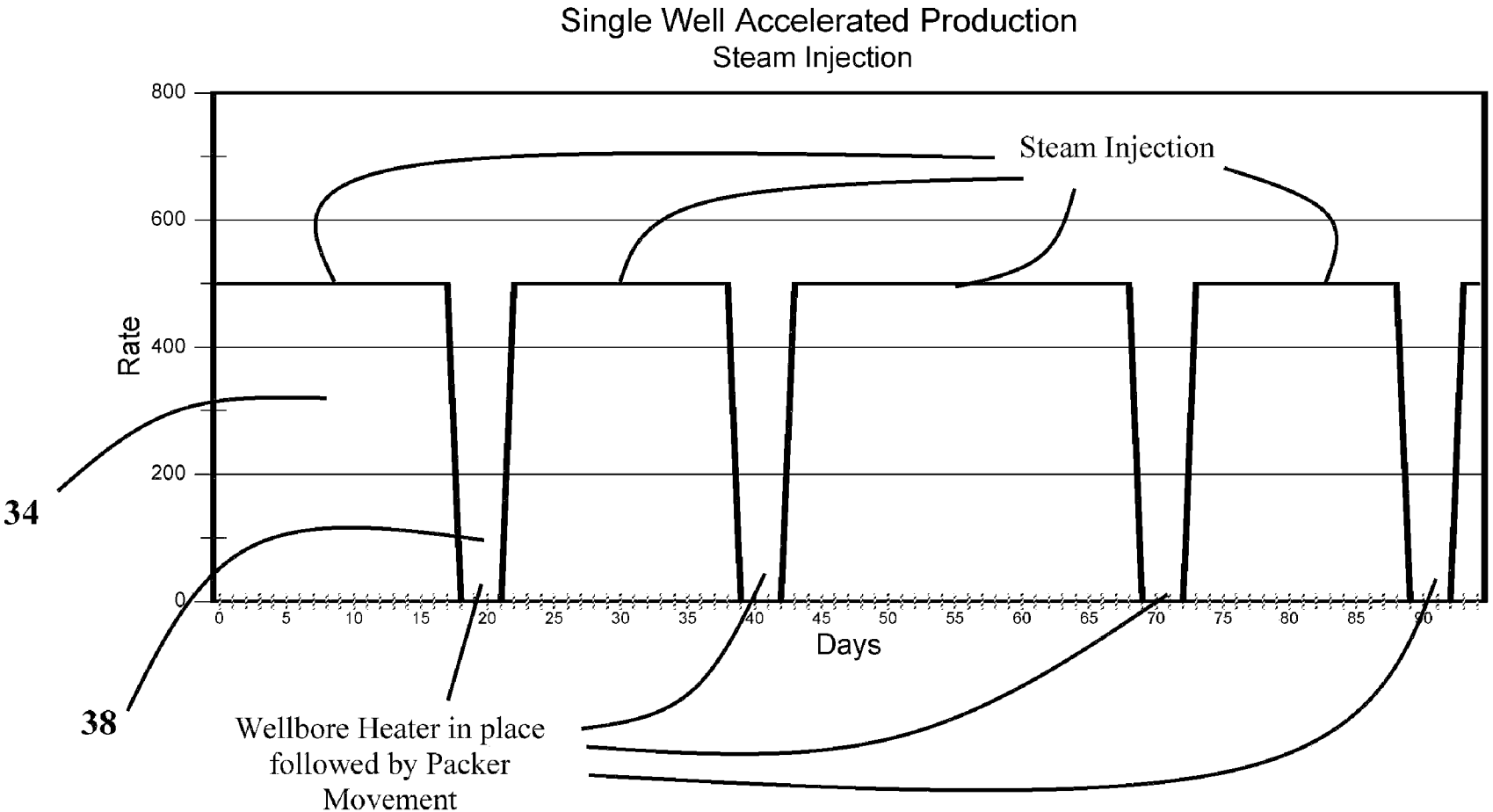
FIG. 14 Shows the graph of the almost continuous steam injection operations implemented in this invention, with the non-injection periods for wellbore annulus heating and moving of retractable packers.

On the other hand, the invention described herein, provides for a very different set of operations. FIG. 14 shows the steam injection period 34 followed by the period 38 in one embodiment in which the wellbore heater 19 is installed in the wellbore and is operated for a fixed time, and during which time the packer 18 is also moved along the wellbore. Note that the steam injection rate is essentially constant, however in practice it is usually necessary to increase the injection rate over time to offset the heat losses as the steam bank increases in size.

Figure 15:
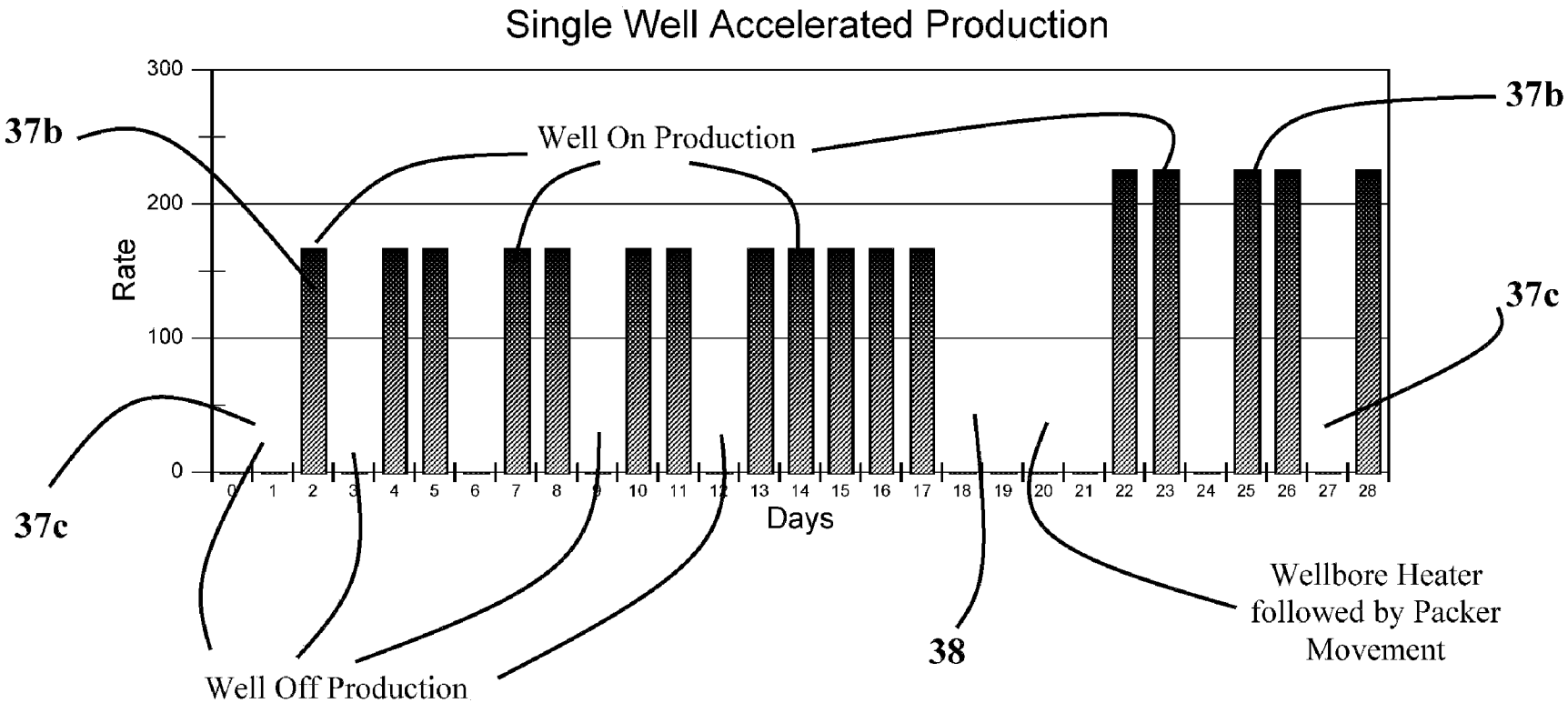
FIG. 15 Shows the on-off oil production graph in a more detailed version of a part of the production cycle early in the life of the field operations.

FIG. 15 shows a more detailed set of operational data where the well production is intermittent. This occurs early in the steam operations since the steam zone or steam bank 20 is still small and growing and the accumulated oil 12 is insufficient to be produced continuously without compromising the hydraulic seal 29 and allowing steam breakthrough in the communication zone 26 and the wellbore 4. This figure shows the oil production rate 37*b* and the oil shut-in period 37*c*.

Figure 16:
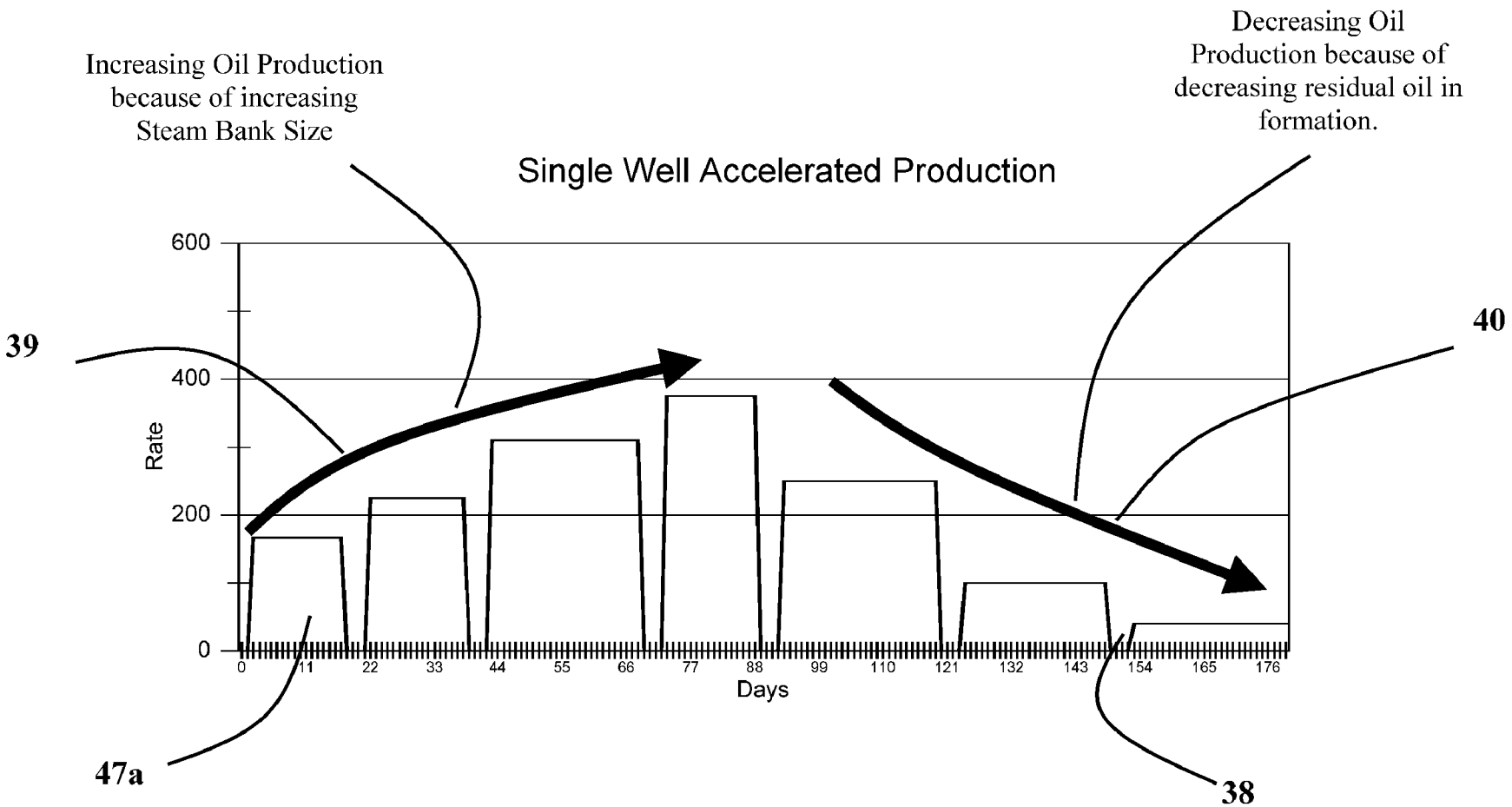
FIG. 16 Shows the graph of the growth trend in oil production rates as the steam injection continues followed by the natural decline accompanying oil reserves depletion.

As the steam bank 20 grows, there is more reservoir formation 5 volume available for oil production and there is a concurrent increase in the oil production rate as shown by the trend line 39 in FIG. 16. This trend continues to a maximum point after which there is an inevitable decline due to heat losses, oil depletion and other factors as shown by trend line 40.

Given the increased oil flow rates which begin soon after steam injection, coupled with the growth of the steam bank by almost continuous steam injection, as opposed to the intermittent injection of the prior art huff and puff method; and the concurrent oil production increase, this invention provides for an improvement in the technology and prior art in a manner which allows significant rapid development of hydrocarbon reserves from heavy and viscous oil from subterranean formations with existing equipment and field operations applied in a manner that has been heretofore lacking.

In this patent certain United States patents, patent applications, and other materials (e.g., articles) have been incorporated by reference. The text of such U.S. patents, U.S. patent applications, and other materials is, however, only incorporated by reference to the extent that no conflict exists between such text and the other statements and drawings set forth herein. In the event of such conflict, then any such conflicting text in such incorporated by reference U.S. patents, U.S. patent applications, and other materials is specifically not incorporated by reference in this patent Further modifications and alternative embodiments of various aspects of the invention may be apparent to those skilled in the art in view of this description. Accordingly, this description is to be construed as illustrative only and is for the purpose of teaching those skilled in the art the general manner of carrying out the invention. It is to be understood that the forms of the invention shown and described herein are to be taken as the presently preferred embodiments. Elements and materials may be substituted for those illustrated and described herein, parts and processes may be reversed, and certain features of the invention may be utilized independently, all as would be apparent to one skilled in the art after having the benefit of this description of the invention. Changes may be made in the elements described herein without departing from the spirit and scope of the invention as described in the following claims.

REFERENCES

1. SPE, The Society of Petroleum Engineers 222 Palisades Creek Dr., Richardson, Tex., 75080, U.S.A., www.spe.org.
2. Harvest Oil Tool Company LLC, 6801 North Peterson Road, Sedalia, Colo. 80135, U.S.A. www.harvesttool.com
3. Dynatec Corporation. www.dynatec.ca.
4. "A Comparison of Mass Rate and Steam Quality Reductions to Optimize Steamflood Performance", Topical Report 108, Gregory L. Messner, July 1998, Stanford University, Stanford, Calif.

I claim:

1. A method for recovering hydrocarbons from a subterranean formation containing viscous oil, oil shale, tar sands or other heavy hydrocarbons; the method comprising the steps of:

(a) drilling a central wellbore down to the hydrocarbon bearing formation by penetrating the formation and the under-burden zones;

(b) reaming out a section of the central wellbore to form a viably located production cavity;

(c) drilling at least one additional wellbore vertically from the surface and then laterally through the said formation to connect said additional wellbore to the said production cavity and further comprising the step of installing a means for active control of the back pressure in this additional wellbore;

(d) providing a plurality of perforations in the said additional wellbore at pre-selected intervals;

(e) installing a downhole wellbore packer between upper and lower perforations;

(f) implementing a means for forming an annular zone of increased fluid conductivity near the said additional wellbore in the said formation;

(g) heating the said formation by injecting a displacing fluid into the formation;

(h) collecting oil and water in the said production cavity;

(i) lifting the produced fluids and displaced fluids to the surface by using a fluid recovery system.

2. The method of claim 1, wherein the central wellbore extends throughout the heavy oil formation.

3. The method of claim 1, wherein the central wellbore extends below the heavy oil formation.

4. The method of claim 1, wherein the wellhead at the proximal end of the additional wellbore is an injection wellhead.

5. The method of claim 1, wherein the perforation zones in the additional wellbore are positioned as paired groups or couplets.

6. The method of claim 5, wherein the proximal perforations in the paired group form an injector set of perforations.

7. The method of claim 5, wherein the next or distal set of perforations in the paired group forms a producer set of perforations.

8. The method of claim 1, wherein the downhole packer in the additional wellbore is placed between the injector and producer pair of perforations separating the injection and production zones.

9. The method of claim 1, wherein the downhole packer forces the injection fluid to exit the additional wellbore and be injected into the hydrocarbon bearing formation.

10. The method of claim 1, wherein the downhole packer is retractable, moveable and can be solid or inflatable.

11. The method of claim 1, wherein the injected fluid is capable of lowering the viscosity of the native fluids.

12. The method of claim 1, wherein the injected fluid forms an elevated temperature cavity or steam bank or chamber in the hydrocarbon reservoir.

13. The method of claim 1, wherein the said annular zone is formed by installing a reaming device and reaming out a portion of the said formation, thereby enlarging the said additional wellbore.

14. The method of claim 13, wherein the reamed zone is concentric to the additional wellbore.

15. The method of claim 13, wherein the reamed zone forms a communication zone from the steam bank to the production zone perforations.

16. The method of claim 1, wherein the downhole packer is moved axially along the wellbore to hydrocarbon rich formations to carry out the said method, after each steam displacing zone is depleted of hydrocarbons.

17. The method of claim 1, wherein the injected steam creates a steam chamber allowing the heated low viscosity oil to drain towards the bottom of the chamber and down through the annular heated conduit zone through the lower production perforations into the wellbore.

18. The method of claim 1, wherein the means for controlling the backpressure in the additional wellbore is an active device.

19. The method of claim 18, wherein the fluid backpressure created in the additional wellbore by the downhole backpressure means limits the bypass of the injected steam from the injection perforations into the producing perforations allowing the steam to enter the oil formation.

20. The method of claim 18, wherein the means for active backpressure control of claim 1 acting in combination with the fluid-filled additional wellbore provides a hydraulic seal.

21. The method of claim 1, wherein the injected fluid provides a means for lowering the viscosity of the displaceable native fluids.

22. The method of claim 1, wherein the said formation is heated by using an elevated temperature chamber or steam bank.

23. The method of claim 1, wherein the heated annular zone extends from below the base of the injection perforations to the top of the production perforations.

24. The method of claim 1, wherein the fluid recovery system is installed within the central wellbore.

25. The method of claim 1, wherein the fluid recovery system is installed within the central production cavity.

26. The method of claim 1, wherein the reaming out step is carried out to form the said production cavity below the hydrocarbon bearing formation.

27. The method of claim 1, wherein the reaming out step is carried out to form the said production cavity within the hydrocarbon bearing formation.

28. The method of claim 1, wherein the reaming out step is carried out to form the said production cavity at the bottom of the hydrocarbon bearing formation.

29. The method of claim 1, wherein the reaming out step is carried out to form the said production cavity partially within the hydrocarbon bearing formation and partially below the hydrocarbon bearing formation.

30. The method of claim 1, wherein the step of drilling additional wellbore comprises drilling a plurality of additional wellbores, and connecting said additional wellbores to the said production cavity.

31. The method of claim 1, wherein a plurality of additional wellbores drilled towards the said production cavity together form a production well pattern of uniwells.

32. The method of claim 1, wherein the said additional wellbore is further drilled upwards from the said production cavity to the surface to form a uniwell.

33. The method of claim 32, wherein the step of drilling additional wellbore comprises drilling a plurality of additional wellbores, towards the production cavity, to form a series of uniwells.

34. The method of claim 18 wherein the means to control the back pressure regulates the flow of fluids in the additional wellbore from zero to 100% of flow capacity.

* * * * *